United States Patent [19]

Stich

[11] Patent Number: 4,829,653

[45] Date of Patent: May 16, 1989

[54] METHOD OF MAKING AN APPLIANCE DOOR HAVING A MODULE SUPPORT SYSTEM

[75] Inventor: Richard A. Stich, Louisville, Ky.

[73] Assignee: General Electric Company, Louisville, Ky.

[21] Appl. No.: 190,925

[22] Filed: May 6, 1988

Related U.S. Application Data

[62] Division of Ser. No. 28,177, Mar. 19, 1987, Pat. No. 4,779,939.

[51] Int. Cl.[4] ..... B23P 25/00

[52] U.S. Cl. ..... 29/458; 29/460; 29/525.1

[58] Field of Search ..... 29/458, 460, 526.1, 29/155 R; 312/138 A, 214; 248/311.2, 221.3, 221.4

[56] References Cited

U.S. PATENT DOCUMENTS

| | | | |
|---|---|---|---|
| Re. 32,435 | 6/1987 | Carlstrom | 248/221.4 X |
| 2,144,885 | 1/1939 | MacFadden | 248/221.4 |
| 2,169,708 | 8/1939 | O'Callaghan | 248/221.4 X |
| 2,749,918 | 6/1956 | Saunders | 62/377 |
| 2,852,328 | 9/1958 | Jewell et al. | 312/214 |
| 3,029,953 | 4/1962 | Morrissey | 108/110 |
| 3,056,640 | 10/1962 | Squire | 312/214 |
| 3,375,936 | 4/1968 | Kessler | 108/108 |
| 3,409,717 | 11/1968 | Nozaki | 264/291 |
| 3,469,711 | 9/1969 | Swaneck et al. | 312/351 |
| 3,502,294 | 3/1970 | Kalbow et al. | 248/311.2 X |
| 3,610,174 | 10/1971 | Kesling | 108/146 |
| 3,807,822 | 4/1974 | Amore | 312/138 A |
| 4,053,972 | 10/1977 | Kardes | 29/458 X |
| 4,107,833 | 8/1978 | Knight et al. | 29/460 |
| 4,174,486 | 11/1979 | Winkler | 312/138 A |
| 4,222,541 | 9/1980 | Gillis | 248/311.2 X |
| 4,325,178 | 4/1982 | Pruehs | 29/460 X |
| 4,387,872 | 6/1983 | Hogue | 248/221.3 |
| 4,531,698 | 7/1985 | Sharber | 248/243 |
| 4,779,325 | 10/1988 | Mullet | 29/460 |

FOREIGN PATENT DOCUMENTS

| | | | |
|---|---|---|---|
| 2130351 | 5/1984 | United Kingdom | 312/214 |

*Primary Examiner*—Charlie T. Moon

*Attorney, Agent, or Firm*—Frederick P. Weidner; Radford M. Reams

[57] ABSTRACT

A refrigerator door has a metallic outer panel and a plastic inner panel with rigid insulating foam therebetween. A track support is attached at a predetermined position to the outer panel. A plurality of tracks is supported by the track support between the inner panel and the foam. Each track has a column of apertures. The inner panel has columns of apertures therein with the number of tracks being at least equal to the number of the columns of apertures in the inner panel. A grommet extends through aligned openings at the top of each track, at the top of each column of apertures in the inner panel, and in the track support to attach the inner panel and the tracks to the track support. A grommet also extends through aligned openings at the bottom of each track and at the bottom of each column of apertures in the inner panel to connect the inner panel and the tracks. The attachment of the inner panel by the grommets aligns each aperture in each column in the inner panel with one of the apertures in one of the tracks. A module is arranged in any vertical position on the inner panel through two sets of hooks on its back extending through apertures in two columns in the inner panel and aligned apertures in two of the tracks with the track support supporting the two sets of hooks whereby the module is supported by the outer panel.

7 Claims, 8 Drawing Sheets

FIG. 8
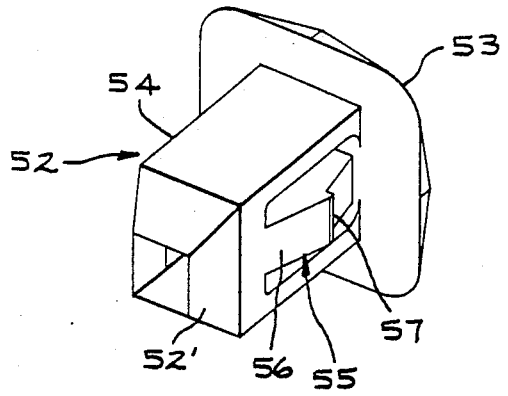
FIG. 6
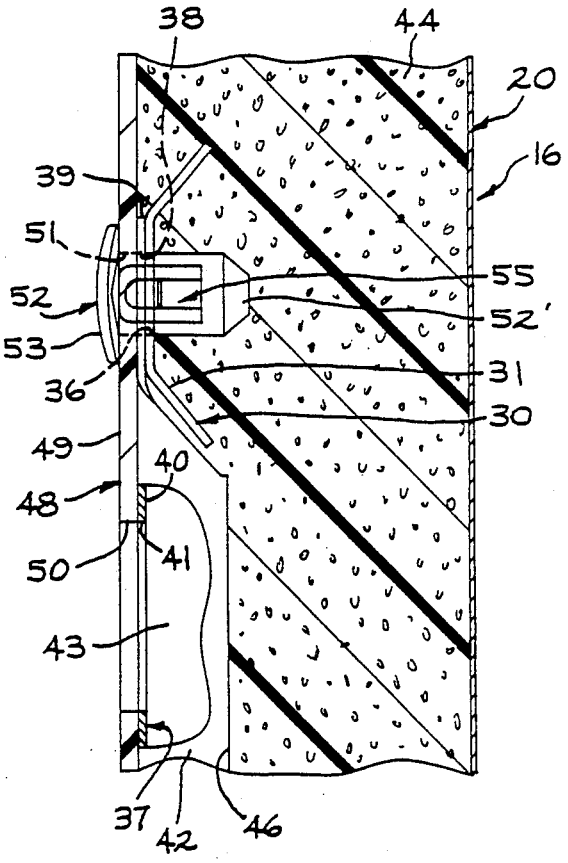
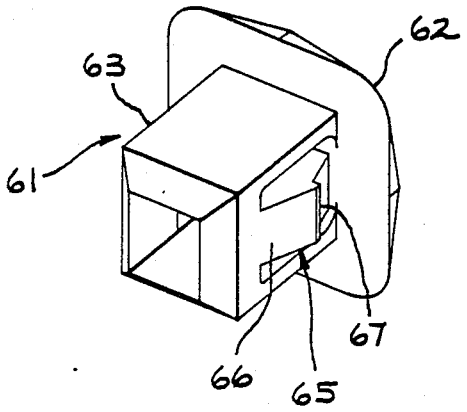
FIG. 9

METHOD OF MAKING AN APPLIANCE DOOR HAVING A MODULE SUPPORT SYSTEM

This is a division of application Ser. No. 028,177, filed Mar. 19, 1987, now U.S. Pat. No. 4,779,939.

FIELD OF THE INVENTION

This invention relates to an appliance door, a method of making, and a module to be supported on the door and, more particularly, to a module support system for an appliance door, a method of making, and a module to be supported by the module support system.

BACKGROUND OF THE INVENTION

Adjustable shelves have previously been utilized on the inside of appliance doors such as refrigerator or freezer doors, for example. The adjustability of the shelves enables a user to be able to support different size articles on the appliance door.

When the appliance door is a refrigerator or freezer door having an outer panel and an inner panel with thermal insulation therebetween, the adjustable shelves have previously been supported on the inner panel. To meet the load requirements of the Underwriters Laboratory, the thickness of the inner panel has had to be increased for increasing loads.

In a two door refrigerator having a fresh food compartment closed by a first door and a freezer compartment closed by a second door, for example, the size of the door for the fresh food compartment usually has been substantially larger than the freezer compartment door. As a result, the thickness of the inner panel of the fresh food compartment door has had to be thicker than the inner panel of the freezer compartment door. This has resulted in the inner panel of the two doors being formed of two different thicknesses to increase manufacturing costs or the smaller of the two doors having its inner panel of the same thickness as the larger of the two doors to increase material costs.

Furthermore, the same problem of costs, either manufacturing or material, of the relative thicknesses of the inner panel existed with respect to refrigerators having different total capacities even for single door refrigerators. Thus, the largest capacity refrigerator would require either its door to have its inner panel of a greater thickness than smaller capacity refrigerators or all refrigerators smaller in capacity than the largest capacity refrigerator to have the inner panel of the door formed of the same thickness as the thickness of the inner panel of the door of the largest capacity refrigerator.

The appliance door of the present invention overcomes the foregoing problems through providing a module support system in which modules, which support the articles and may be deemed adjustable shelves, have their load substantially carried by the outer door assembly of the door rather than its inner panel. This enables the inner panel to be the same thickness irrespective of the load applied to the modules. Therefore, there is not the requirement of either the inner panel of the appliance door having different thicknesses for different size doors or the inner panels of the doors for all size refrigerators having the maximum thickness of the inner panel of the largest size door.

Additionally, by attaching the load to the outer door assembly, which is formed of a steel outer panel and rigid foam, loads of the modules are relatively small for a steel-foam composite in comparison with plastic, which is the material of the inner panel, so that relatively large loads can be accommodated without having to change the thickness of the outer door assembly. Since the steel-foam composite has a longer life than plastic, the support of the modules by the steel-foam composite outer door assembly creates a longer life than previously available supports for adjustable shelves in which the shelves are supported by the plastic inner panel of the appliance door.

Furthermore, the module of the present invention is formed with sets of hooks supported on its back and bottom walls so that the same load can be supported with a lesser thickness of the walls of the module or a lower performance plastic material of the same thickness than previously available modules having sets of hooks only on their back walls. Thus, a cantilevered mounted module can be produced at less cost when mounting the sets of hooks on the back and bottom walls of the module.

SUMMARY OF THE INVENTION

The appliance door of the present invention contemplates supporting the module, which has two sets of hooks, with each set of hooks extending through aligned apertures in one of two columns in the inner panel and in one of two tracks, which are supported by track support means. The track support means is precisely positioned with respect to the outer panel so that the load of each module is transferred through the two sets of hooks to the tracks, from the tracks to the track support means, and then to the steel-foam composite of the outer door assembly.

The module of the present invention is formed of a plastic and has two sets of metallic hooks. By forming each set of hooks of two substantially perpendicular portions and attaching the portions to the back and bottom walls of the module for substantially the entire length of the back wall and preferably a minimum of two-thirds of the length of the bottom wall, the sets of hooks will carry most of the load of the module rather than the structure of the module.

An object of this invention is to provide a module support system for an appliance door.

Another object of this invention is to provide an appliance door for supporting a module and having inner and outer panels attached to each other with the inner panel being the same thickness irrespective of the module load on the door.

A further object of this invention is to provide a method of making an appliance door having a module support system.

Still another object of this invention is to provide a cantilevered mounted module of plastic capable of supporting greater loads for a specific thickness of the module.

Other objects of this invention will be readily perceived from the following description, claims, and drawings.

BRIEF DESCRIPTION OF THE DRAWINGS

The attached drawings illustrate a preferred embodiment of the invention, in which:

FIG. 6 is an enlarged fragmentary sectional view, partly in side elevation, of the freezer compartment door of FIG. 1 showing an upper grommet supporting a track and an inner panel on the track support means and taken along line 6—6 of FIG. 4;

FIG. 8 is an isometric view of an upper grommet for supporting the track and the inner panel on the track support means;

FIG. 9 is an isometric view of a lower grommet for connecting the lower end of the track and the inner panel to each other;

DESCRIPTION OF THE PREFERRED EMBODIMENT

Figure 1:
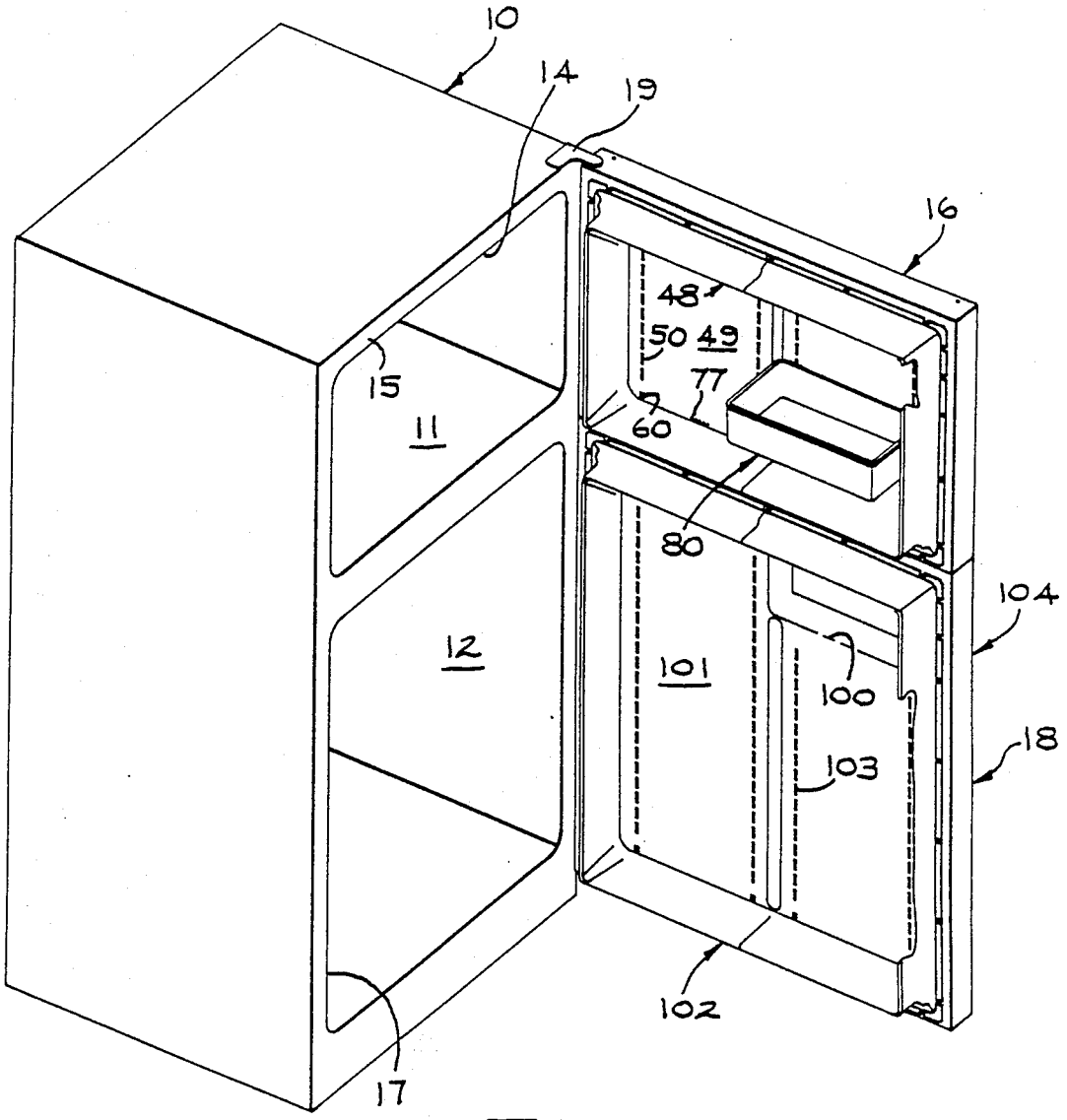
FIG. 1 is an isometric view of a two compartment refrigerator cabinet in which each of its doors has a module support system of the present invention with the doors being shown in an open position and the doors being shown without a gasket, the support brackets, and retaining screws.

Referring to the drawings and particularly FIG. 1, there is shown a refrigerator cabinet 10 having a freezer compartment 11 and a fresh food cooling compartment 12. The freezer compartment 11 has its access opening 14 in a front wall 15 of the cabinet 10 closed by a door 16. The fresh food cooling compartment 12 has its access opening 17 in the front wall 15 closed by a door 18.

Each of the doors 16 and 18 is hingedly connected to the cabinet 10. A hinge 19 for the door 16 is shown in FIG. 1.

Figure 2:
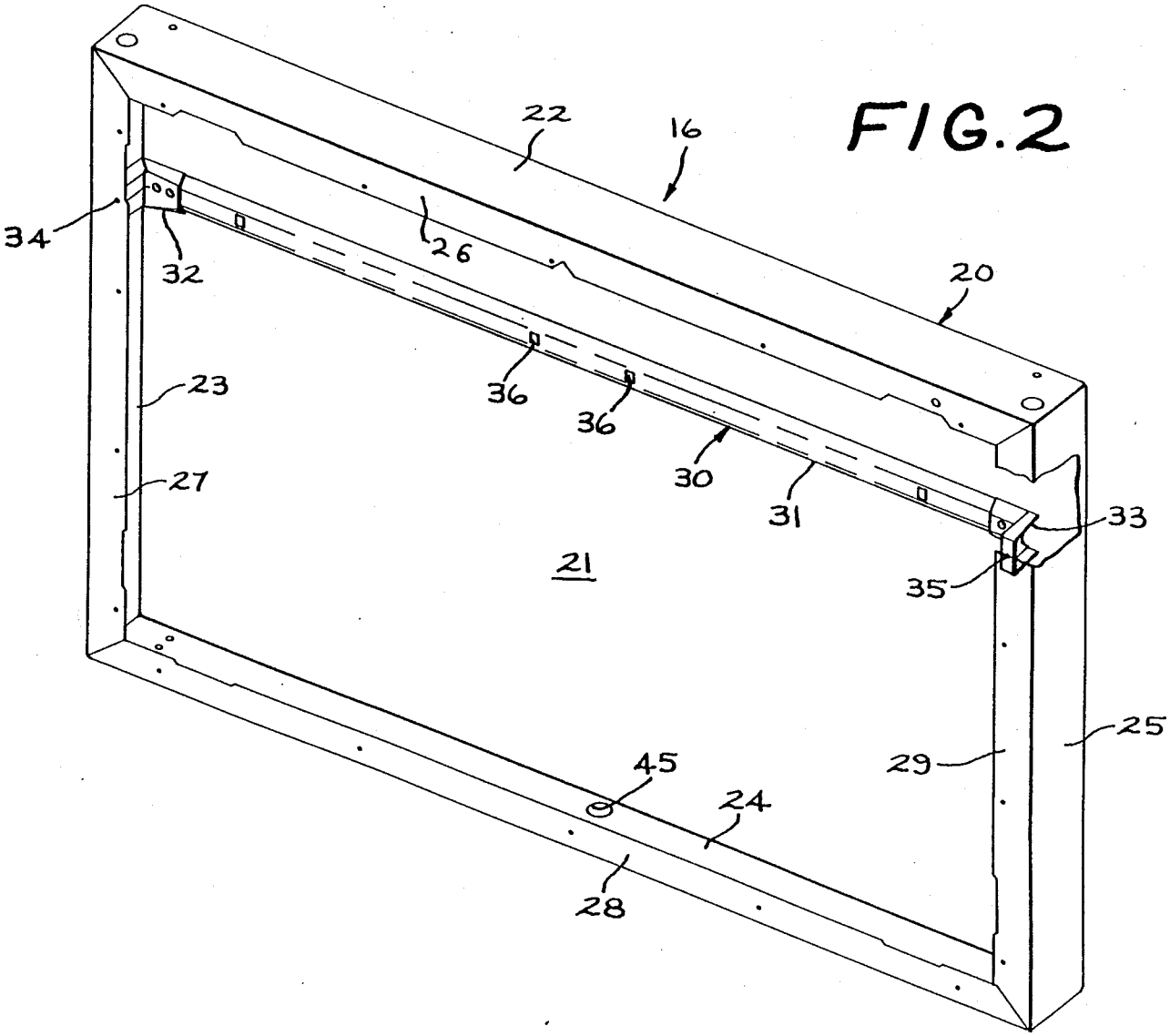
FIG. 2 is an isometric view of an outer panel of the freezer compartment door of FIG. 1 showing its track support means and partly broken away to show mounting of one end of the track support means.

The freezer compartment door 16 includes an outer panel 20 (see FIG. 2) formed of steel. The outer pane 20 has a base 21 with flanges 22, 23, 24, and 25 extending therefrom substantially perpendicular thereto. Each of the flanges 22, 23, 24, and 25 has a flange 26, 27, 28, and 29, respectively, extending therefrom substantially perpendicular thereto and substantially parallel to the base 21.

A crosspiece assembly 30 is located on the outer panel 20 at a predetermined position. The crosspiece assembly 30 includes a metallic crosspiece 31 and plastic connectors or isolators 32 and 33 at opposite ends of the metallic crosspiece 31. Each of the plastic isolators 32 and 33 is attached to the metallic crosspiece 31 by suitable means such as welding or rivets, for example. The plastic isolators 32 and 33 prevent heat exchange to the outer panel 20 to avoid sweating of the outer panel 20 of the door 16 due to the low temperature within the freezer compartment 11 (see FIG. 1) of the refrigerator cabinet 10.

The isolator 32 (see FIG. 2) is connected to the flange 27 of the outer panel 20 by a rivet 34. The isolator 33 is secured to the flange 29 of the outer panel 20 by a rivet 35. The hole in the flange 27 of the outer panel 20 for the rivet 34 and the hole in the flange 29 of the outer panel 20 for the rivet 35 are precisely located. Thus, the crosspiece assembly 30 is at a predetermined position with respect to the outer panel 20.

The metallic crosspiece 31 of the crosspiece assembly 30 has four rectangular shaped openings or apertures 36 therein. The number of the openings 36 is equal to the number of U-shaped tracks 37 (see FIG. 4), which are to be supported by the crosspiece assembly 30 (see FIG. 2). With four of the tracks 37 (see FIG. 4), there are four of the openings 36 (see FIG. 2).

Figure 4:
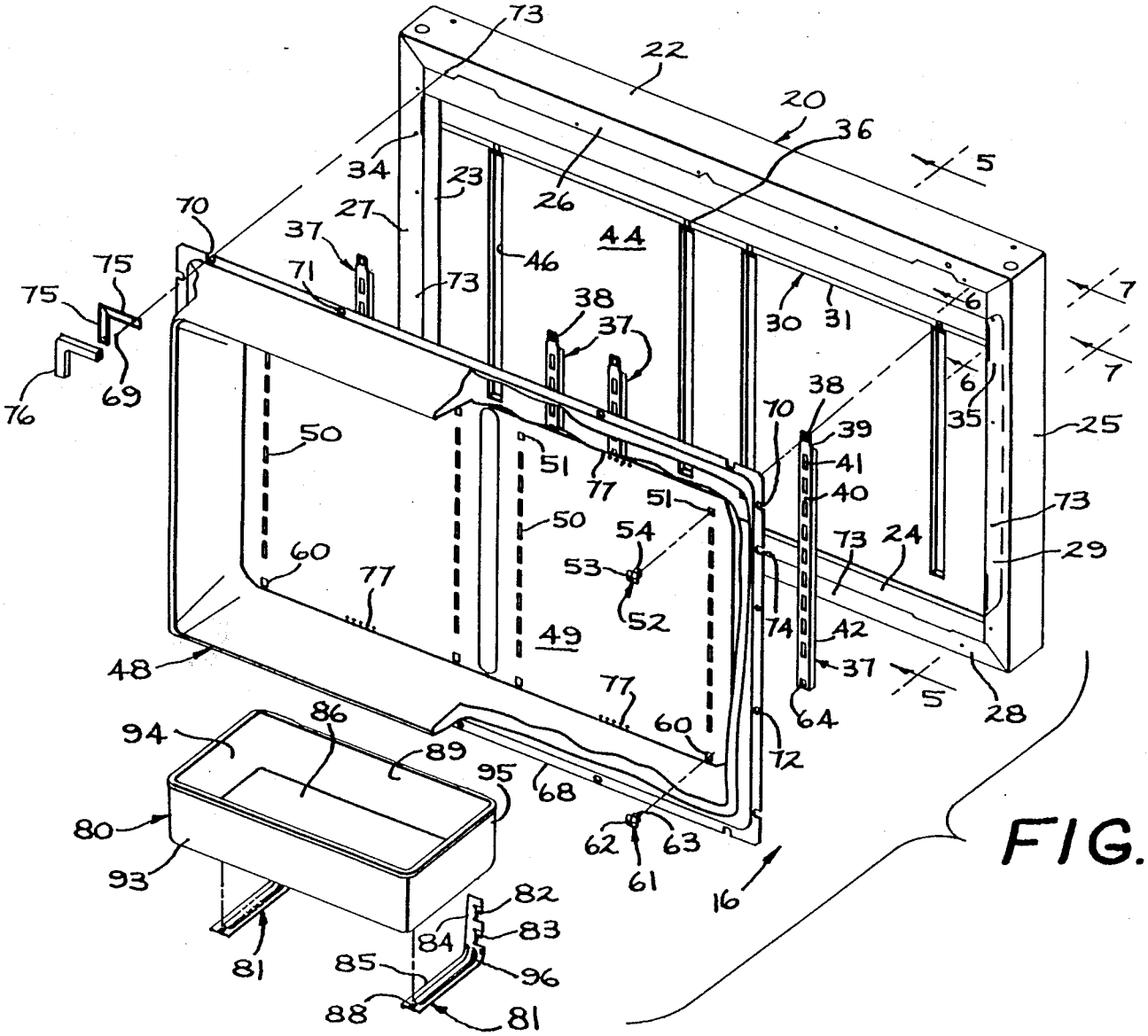
FIG. 4 is an exploded isometric view of the freezer compartment door of FIG. 1 including a module for support on the door.

As shown in FIG. 4, each of the tracks 37 has a rectangular shaped opening or aperture 38 in its upper end 39 for alignment with one of the rectangular shaped openings 36 in the metallic crosspiece 31 of the crosspiece assembly 30. Each of the tracks 37 has a main flat portion or base 40 with a plurality of rectangular shaped openings or apertures 41 therein arranged in a column and side portions or legs 42 and 43 (see FIG. 6) extending substantially perpendicular to opposite sides of the main flat portion or base 40 (see FIG. 4).

Figure 3:
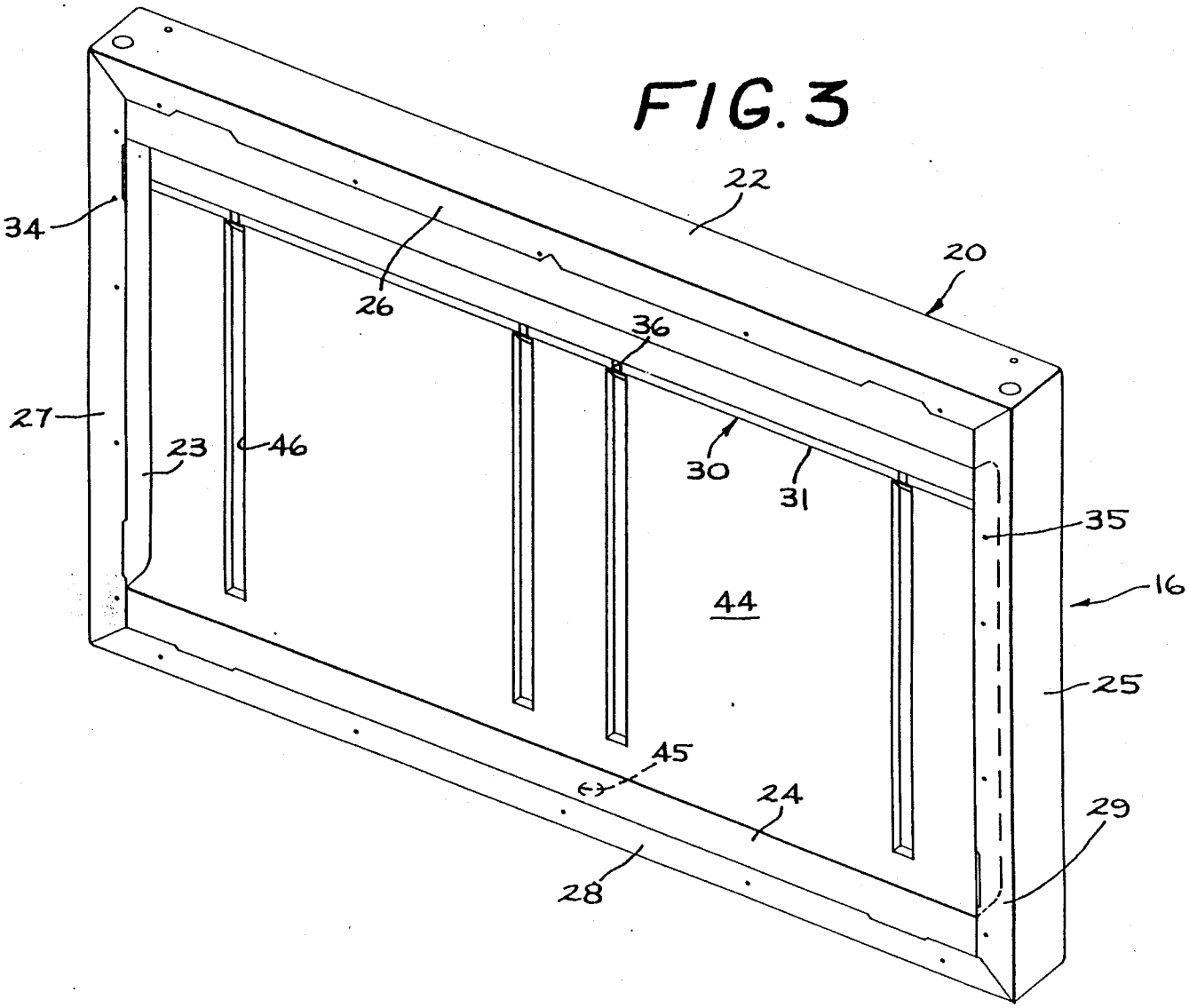
FIG. 3 is an isometric view of the outer panel of FIG. 2 and showing insulating foam within the outer panel with the track support means foamed in place.

After the crosspiece assembly 30 (see FIG. 2) is precisely positioned with respect to the outer panel 20 of the freezer compartment door 16 by being fixed thereto by the rivets 34 and 35, the outer panel 20 is positioned within a mold so that an insulating foam 44 (see FIG. 3) is injected through a hole 45 in the flange 24 of the outer panel 20 into the interior of the outer panel 20 so as to overlie most of the crosspiece assembly 30. The foam 44 may be any suitable thermal insulating foam that is a rigid, free rising foam. The foam 44 is preferably polyurethane foam. Another suitable example of the foam 44 is polyisocynate foam.

The foam 44 has a plurality of longitudinally parallel slots 46 formed therein with each of the slots 46 receiving one of the tracks 37 (see FIG. 4). The slots 46 in the foam 44 are aligned with each of the rectangular shaped openings 36 in the metallic crosspiece 31 of the crosspiece assembly 30. The surface of the foam 44 is level with the crosspiece 31 when the foam 44 is cured.

After the foam 44 is cured, the crosspiece assembly 30 is also held in the predetermined position on the outer panel 20 by the foam 44, which forms a steel-foam composite with the outer panel 20 of steel. If the crosspiece assembly 30 could be disposed in the predetermined position relative to the outer panel 20 without having to be attached thereto, the crosspiece assembly 30 would remain in the predetermined position after the foam 44 has cured, and the isolators 32 and 33 would not be necessary.

As shown in FIG. 4, the freezer compartment door 16 includes an inner panel 48 of a plastic such as ABS, for example, with a thickness of 0.060", for example. The inner panel 48 has a base 49 for disposition against the foam 44 in the outer panel 20.

The base 49 has a plurality of columns of rectangular shaped apertures or openings 50 therein. The number of the tracks 37 must equal the number of the columns of the apertures 50 in the base 49 of the inner panel 48. Thus, with four of the columns of the apertures 50 in the base 49 of the inner panel 48, there are four of the tracks 37.

The base 49 of the inner panel 48 has a rectangular shaped opening or aperture 51, which is smaller than the apertures 50 but the same size as the opening 38 in the upper end 39 of the track 37, above the upper end of each of the columns of the apertures 50. Each of the openings 51 has a screw grommet 52 of plastic inserted therethrough and through the opening 38 in the upper end 39 of the track 37 into the corresponding rectangular shaped opening 36 in the metallic crosspiece 31 of the crosspiece assembly 30. Because the grommet 52 has a tapered end 52' (see FIG. 8), it pierces into the foam 44 as shown in FIG. 6.

The grommet 52 (see FIG. 4) includes a head 53 engaging the base 49 of the inner panel 48 and a rectangular shaped portion 54 for extending through the opening 51 in the base 49 of the inner panel 48, the opening 38 in the upper end 39 of the track 37, the opening 36 in the metallic crosspiece 31 of the crosspiece assembly 30, and into the foam 44. The rectangular shaped portion 54 of the grommet 52 includes a pair of locking fingers 55 (see FIG. 6) on opposite sides thereof.

As shown in FIG. 8, each of the locking fingers 55 includes a cam surface 56 to enable the finger 55 to pass through the rectangular shaped opening 51 (see FIG. 4) in the base 49 of the inner panel 48, the rectangular shaped opening 38 in the upper end 39 of the track 37, and the square shaped opening 36 in the metallic crosspiece 31 of the crosspiece assembly 30 into the foam 44. After the cam surface 56 (see FIG. 8) is advanced so that its edge 57 has advanced past the opening 36 (see FIG. 2) in the metallic crosspiece 31 of the crosspiece assembly 30, the edge 57 (see FIG. 8) forms a locking surface with the rear of the metallic crosspiece 31 (see FIG. 2) of the crosspiece assembly 30 to retain the grommet 52 in the position of FIG. 6.

Each column of the apertures 50 (see FIG. 4) has a rectangular shaped opening or aperture 60 beneath its lower end. Each of the bottom openings 60 is smaller in height than each of the apertures 50. Each of the bottom openings 60 in the base 49 of the inner panel 48 receives a plastic grommet 61.

Each of the lower grommets 61 includes a head 62 engaging the base 49 of the inner panel 48 and a rectangular shaped portion 63 extending through the bottom opening 60 in the base 49 of the inner panel 48 and a rectangular shaped opening 64 in the bottom of the main flat portion or base 40 of the track 37 into the slot 46 in the foam 44. The openings 60 and 64 are the same size and have a tight fit with the rectangular shaped portion 63 of the grommet 61.

Figure 5:
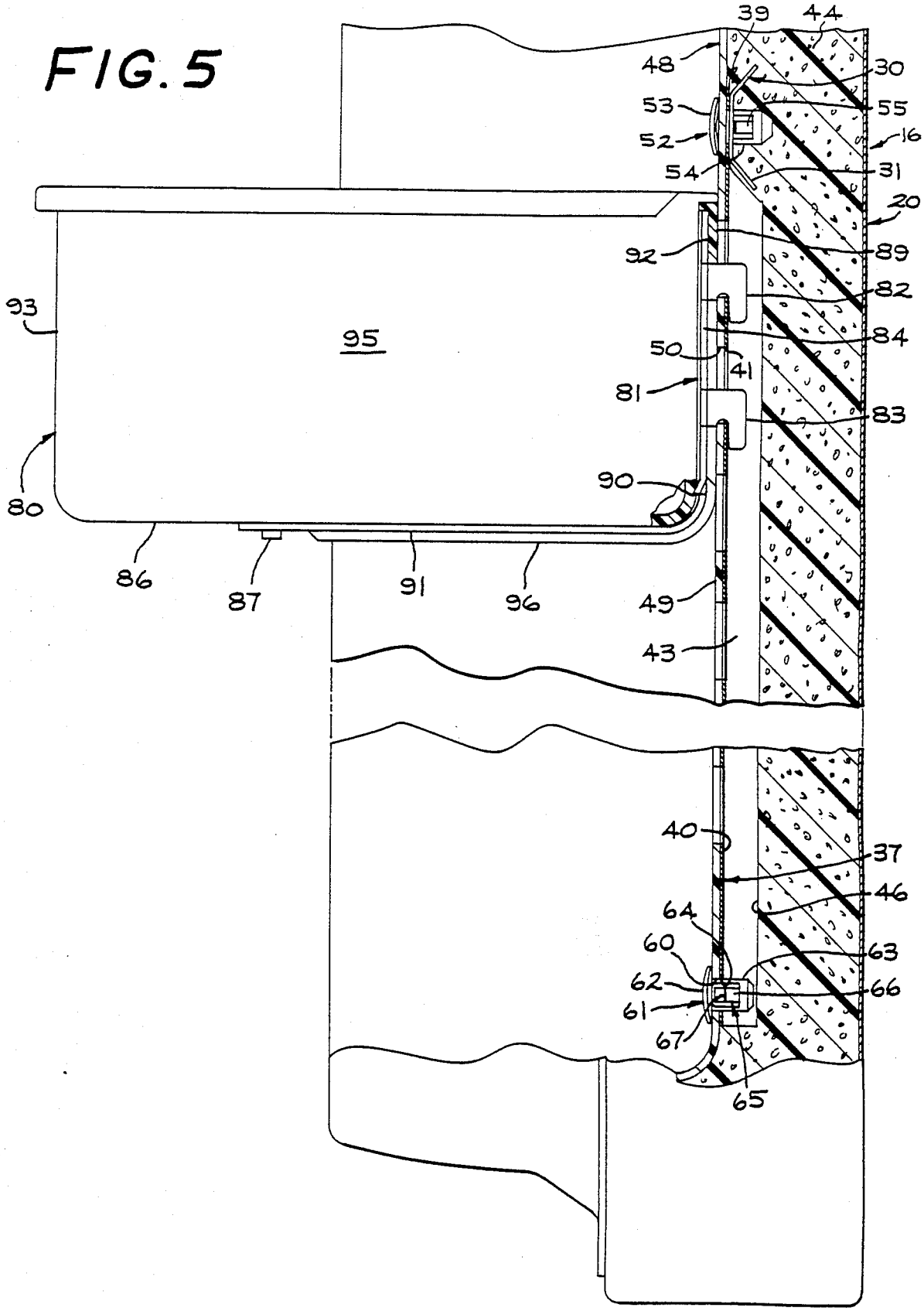
FIG. 5 is a fragmentary sectional view, partly in side elevation, of a portion of the freezer compartment door taken along line 5—5 of FIG. 4 and showing an upper grommet for supporting a track and an inner panel on the track support means, a lower grommet for connecting the lower end of the track and the inner panel, and a module mounted on the track.
Figure 7:
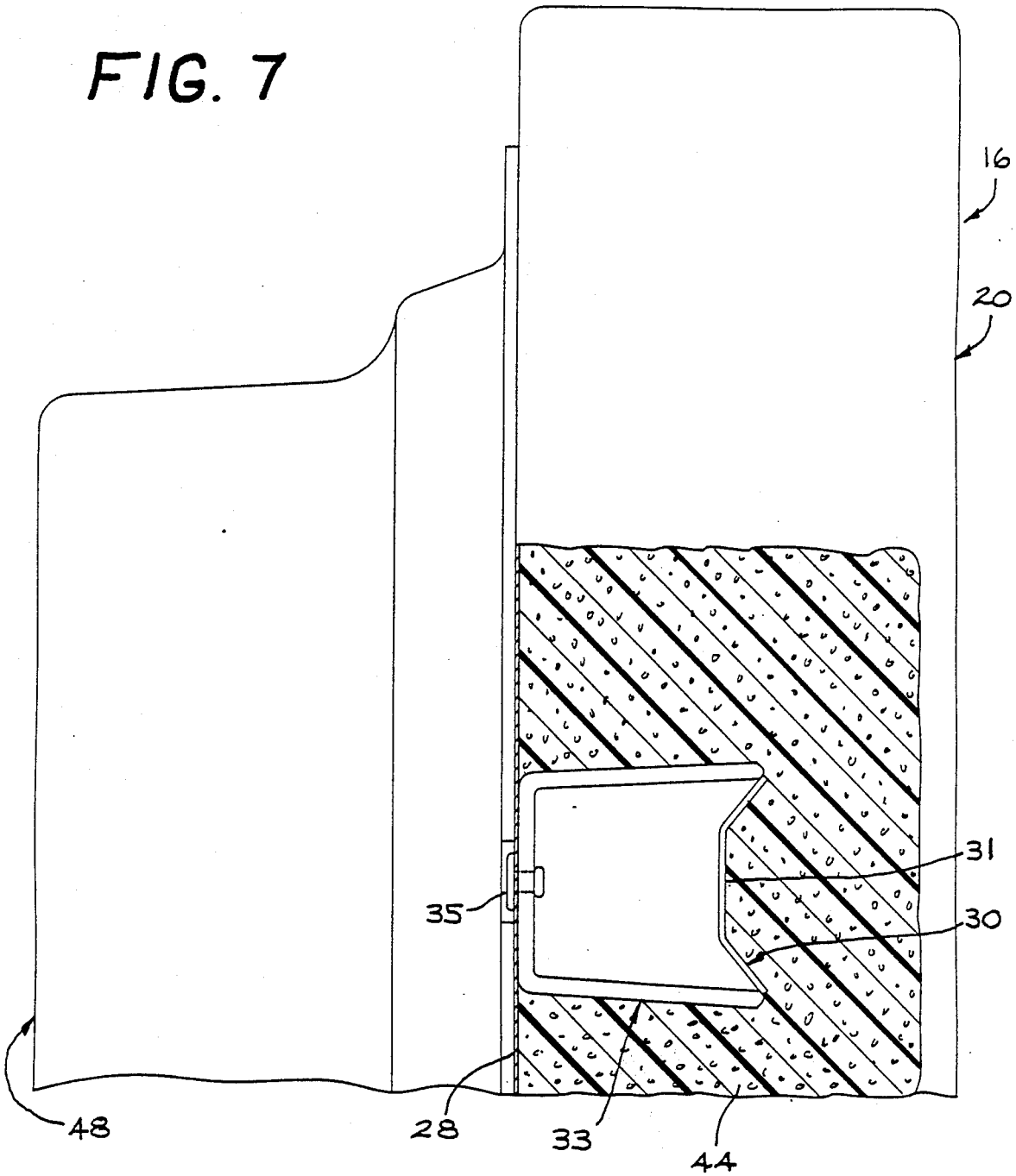
FIG. 7 is a fragmentary side elevational view, partly in section, of a portion of the freezer compartment door of FIG. 1 showing the track support means attached to the outer panel of the door and taken along line 7—7 of FIG. 4.

The rectangular shaped portion 63 of the grommet 61 includes a pair of locking fingers 65 (see FIG. 5) on opposite sides thereof. As shown in FIG. 9, each of the locking fingers 65 has a cam surface 66 to enable the finger 65 to pass through the rectangular shaped bottom opening 60 (see FIG. 4) in the base 49 of the inner panel 48 and the rectangular shaped opening 64 in the lower end of the track 37 into the slot 46 in the foam 44 as shown in FIG. 5. After the cam surface 66 (see FIG. 9) is advanced so that its edge 67 has advanced past the bottom opening 64 (see FIG. 4) in the lower end of the track 37, the edge 67 (see FIG. 9) forms a locking surface with the rear of the main flat portion or base 40 (see FIG. 4) of the track 37 to retain the grommet 61 in the position of FIG. 5 and lock the bottom of the track 37 to the base 49 of the inner panel 48.

Thus, each of the tracks 37 (see FIG. 4) has the upper end 39 attached to the crosspiece assembly 30 so that the upper end 39 of each of the tracks 37 is at a specific location. The lower end of each of the tracks 37 is connected to the base 49 of the inner panel 48.

It should be understood that the tracks 37 are secured to the inner panel 48 prior to attachment of the tracks 37 and the inner panel 48 to the crosspiece assembly 30. After the tracks 37 and the inner panel 48 are connected by the upper grommets 52 and the lower grommets 61, the inner panel 48 is positioned relative to the outer panel 20 so that the tracks 37 are disposed within the slots 46 in the foam 44 of the outer panel 20 and the upper grommets 52 are inserted into the rectangular shaped openings 36 in the metallic crosspiece 31 of the crosspiece assembly 30.

Then, the inner panel 48 has its peripheral mounting flange 68 positioned so that screws 69 (one shown) may be inserted through notches 70, elongated holes 71, and circular holes 72 in the mounting flange 68 of the inner panel 48 into screw start holes 73 in each of the flanges 26-29 to position the inner panel 48 with respect to the outer panel 20 while securing it thereto. The mounting flange 68 also has notches 74 (one shown) in its opposite vertical portions to clear the heads of the rivets 34 and 35. The precise location of the crosspiece assembly 30 on the outer panel 20 insures that the notches 70 and the holes 71 and 72 in the mounting flange 68 of the inner panel 48 are aligned with the screw start holes 73.

When securing the inner panel 48 to the outer panel 20 with the screws 69, the elongated holes 71 enable slight lateral adjustment of the inner panel 48 with respect to the outer panel 20. At the time of mounting the inner panel 48 on the outer panel 20 with the screws 69, four gasket brackets 75 (two shown), which overlie the mounting bracket 68 and are shown only in FIG. 4, are attached by the screws 69 passing through the notches 70 and the holes 71 and 72 in the mounting bracket 68. The gasket brackets 75 cooperate with a gasket 76 to retain the gasket 76 on the door 16 through having a very small portion of the gasket 76 extend into a groove in each of the brackets 75 as more particularly shown and described in the copending patent application of Keith W. Gerdes et al for "Refrigerator And Method Of Gasket Assembly Construction," Ser. No. 869,589, filed June 2, 1986, now U.S. Pat. No. 4,644,698 and assigned to the same assignee as the assignee of this application.

The base 49 of the inner panel 48 has sets of ventilation holes 77 therein. The ventilation holes 77 allow air to flow between the foam 44 and the inner panel 48 to prevent condensation that would form ice.

Figure 10:
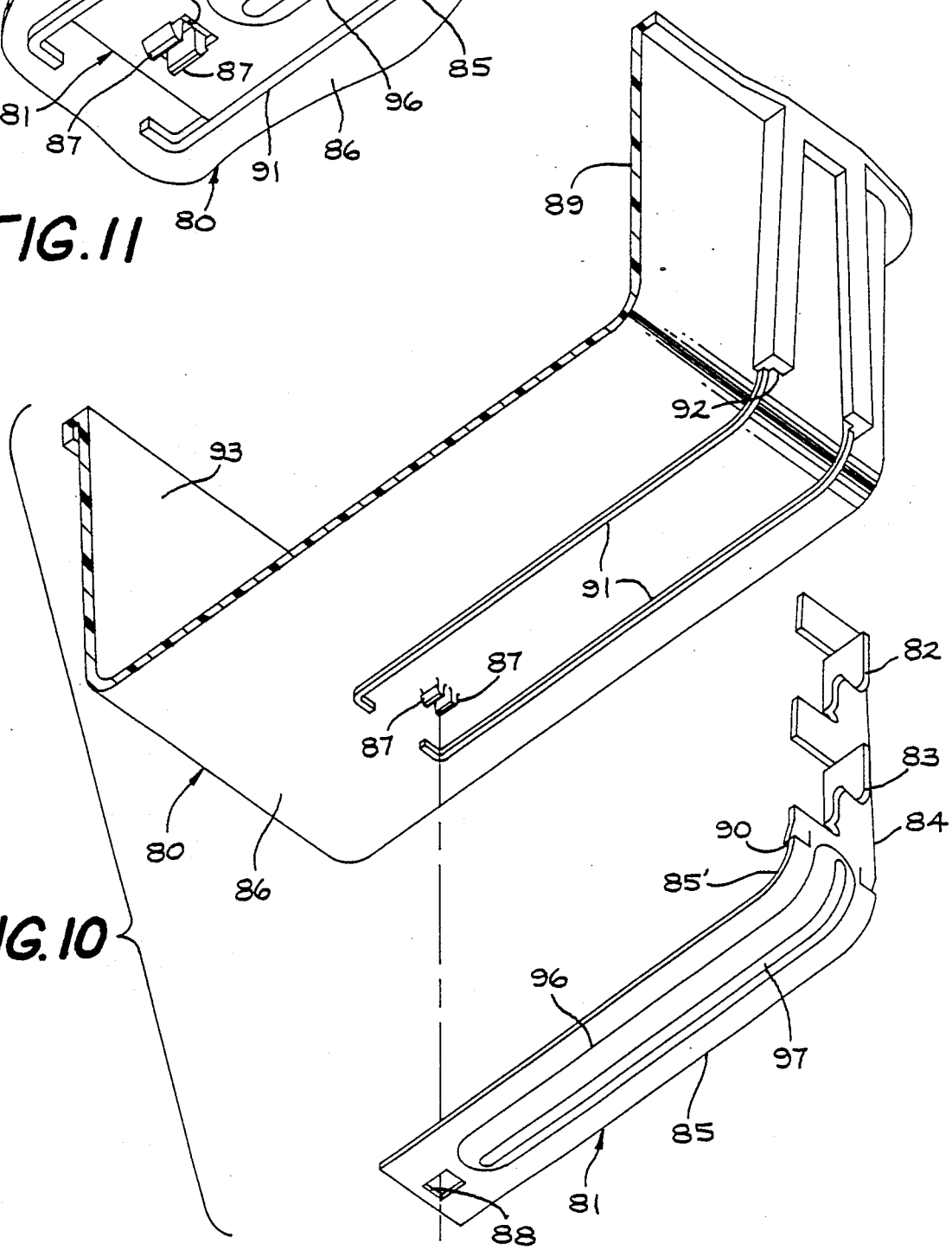
FIG. 10 is an isometric view, partly in section, of a portion of a module of the present invention and one of the hook means for connection thereto.

A rigid plastic module 80 has two sets or pairs 81 of metallic hooks attached thereto. Each of the sets 81 of hooks includes two hooks 82 (see FIG. 10) and 83 vertically spaced from each other on a vertical portion 84.

Each of the sets 81 of hooks has its bottom portion 85 substantially perpendicular to the vertical portion 84 with the portions 84 and 85 being joined along a curved portion 85'. The bottom portion 85 is attached to the module 80 at its bottom wall 86 by two spaced tabs 87, which are integral with the bottom wall 86 of the module 80 and extend downwardly therefrom, extending through an opening 88 in the bottom portion 85 of each of the sets 81 of hooks. With two of the sets 81 of hooks, there is a total of four of the tabs 87 with each set of the two spaced tabs 87 being disposed in one of the openings 88 in the bottom portion 85 of each of the sets 81 of hooks.

Figure 11:
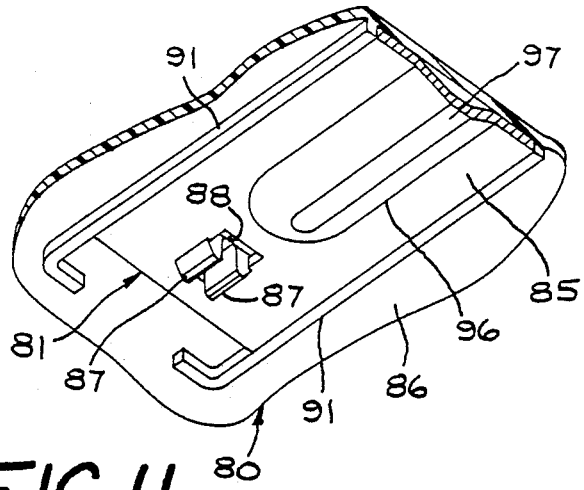
FIG. 11 is a fragmentary perspective view of a portion of the module and one of the hook means of FIG. 10.

The opening 88 in the bottom portion 85 of each of the sets 81 of hooks has a snap fit with the two spaced tabs 87 only on its sides as shown in FIG. 11. There is a loose fit or clearance in the longitudinal direction of the bottom portion 85 of each of the sets 81 of hooks with the two spaced tabs 87. This clearance is necessary to compensate for variable shrinkage of the plastic material of the module 80 (see FIG. 10) during cooling. This is necessary since the module 80 has its back wall 89 engaged by a projection 90 (see FIG. 5) on each of the sets 81 of hooks. The distance between the two spaced tabs 87 and the projection 90 varies during cooling of the plastic material of the module 80 so that failure to have the bottom portion 85 (see FIG. 10) of each of the sets 81 of hooks be able to move relative to the two spaced tabs 87 would result in the opening 88 in the bottom portion 85 of each of the sets 81 of hooks not being aligned with the tabs 87. This would result in the inability to attach the bottom portion 85 of each of the sets 81 of hooks to the bottom wall 86 of the module 80.

The bottom wall 86 of the module 80 has locking guides 91 for the bottom portion 85 of each of the sets 81 of the hooks, and the back wall 89 of the module 80 has a channel 92 for the vertical portion 84 of each of the sets 81 of hooks. This insures that each of the sets 81 of the hooks is properly located on the module 80 and attached thereto.

The back wall 89 of the module 80 extends substantially perpendicular to the bottom wall 86 of the module 80 as do a front wall 93 and side walls 94 (see FIG. 4) and 95 of the module 80. Thus, a rectangular shaped opening in the top of the module 80 is provided.

The tabs 87 (see FIG. 10) are preferably disposed slightly less than two-thirds of the distance from the back wall 89 of the module 80 so that the bottom portion 85 of each of the sets 81 of hooks extends for at least two-thirds of the distance from the back wall 89 towards the front wall 93. This significantly reduces the stresses on the back wall 89 and provides a second load path for the load within the module 80.

Because the sets 81 of hooks are small relative to the module 80, the load is primarily supported by the sets 81 of hooks and then transferred to the tracks 37 (see FIG. 4). This prevents most of the load being applied to the back wall 89 of the module 80. The load sharing is dependent upon the relative rigidity between the module 80 and the sets 81 of hooks. With the sets 81 of hooks being formed of steel and the module 80 of plastic, the stiffness ratio between the sets 81 of hooks and the module 80 is in a range between 10 to 1 and 50 to 1.

The specific ratio depends on the specific plastic material of the module 80 and the specific steel forming the sets 81 of hooks. It also depends on the size of the sets 81 of hooks relative to the module 80. With the relative sizes of FIG. 4, the sets 81 of hooks carry about two-thirds of the load. Accordingly, this mounting arrangement of the sets 81 of hooks on the module 80 enables the module 80 to be formed of a thinner or weaker plastic material and carry the same design load as those in which the hooks have previously been supported only on a back wall of a module.

Each of the sets 81 of hooks also has a rib 96 (see FIG. 10) to stiffen the bottom portion 85 and the curved portion 85'. The rib 96, which is formed on a radius with a central flat portion 97, increases the moment of inertia of each of the sets 81 of hooks to increase the stiffness.

As shown in FIG. 5, each of the hooks 82 and 83 extends through one of the rectangular shaped apertures 50 in the base 49 of the inner panel 48 and the aligned rectangular shaped opening 41 in the track 37. Thus, the hooks 82 and 83 are disposed within the slot 46 in the foam 44.

Therefore, the module 80 (see FIG. 4) is supported in either the two rightmost columns of the apertures 50 in the base 49 of the inner panel 48 or the two leftmost columns of the apertures 50 in the base 49 of the inner panel 48 since these are spaced the distance between the sets 81 of hooks. Thus, the module 80 is substantially supported by the crosspiece assembly 30.

The mounting arrangement of the tracks 37 and the inner panel 48 on the crosspiece assembly 30 results in substantially the entire shear load of the module 80 being carried by the outer panel 20 of the freezer compartment door 16. Since the outer panel 20 is steel and forms a steel-foam composite with the foam 44 and the inner panel 48 is plastic, the steel-foam composite is about ten times as stiff as the plastic whereby the ratio of the shear load on the outer panel 20 and the attached foam 44 to the inner panel 48 is about 10 to 1.

One-half of the rotational moment created by the module 80 being supported by the crosspiece assembly 30 is carried by the crosspiece assembly 30 so that this portion of the rotational moment is transferred to the outer panel 20 of the freezer compartment door 16. The other half of the rotational moment is shared by the inner panel 48 through the lower grommets 61 and the rigid foam 44 through the track legs 42 or 43. However, the total rotational moment load is relatively small in comparison with the shear load.

As a result, the thickness of the inner panel 48 can be substantially thinner than previously available inner panels. This is because the inner panel of prior refrigerator doors relied upon the inner panel to transfer the entire load to the outer panel. Thus, no variation in the thickness of the inner panel 48 for different size loads is required with the mounting arrangement of the present invention.

The door 18 (see FIG. 1) is similarly formed to the door 16. Because of a recess 100 in a base 101 of an inner panel 102 of the door 18, rectangular shaped apertures 103, which are the same as the rectangular shaped apertures 50 (see FIG. 4) in the base 49 of the inner panel 48, in the two rightmost columns do not extend for the length of the door 18 (see FIG. 1) but terminate beneath the recess 100, which enables a dairy tray, for example, to be mounted in the door 18.

It should be understood that the door 18 does not require the crosspiece assembly 30 (see FIG. 2) to include the isolators 32 and 33. Thus, the crosspiece 31 could be changed in shape by extending it so that it is directly attached to an outer panel 104 (see FIG. 1) of the door 18.

An advantage of this invention is that an appliance door, which has an inner panel attached to an outer panel, may have its inner panel of the same thickness for different module loads. Another advantage of this invention is that a module support system has greater strength. A further advantage of this invention is that the weight of an inner panel of an appliance door attached to an outer panel is decreased. Still another advantage of this invention is that the weight of a module is substantially carried by an outer panel of an appliance door having a connected inner panel on which the module is disposed adjacent thereto. A still further advantage of this invention is that the cost of producing a module is substantially decreased through using a much thinner material to support the same load by attaching the sets of hooks to both the bottom wall and the back wall of the module.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A method of making an appliance door having a module support system including:

forming a metallic outer door panel; positioning track support means on (a) the metallic outer panel of the door at a predetermined position;

adhering a rigid foam to the metallic outer panel;

forming each of a plurality of tracks with a plurality of apertures arranged in a column;

supporting an upper end of each of the tracks on the track support means;

forming a plastic inner panel of the door with a plurality of columns of apertures for receiving hook means on a module to be supported with the number of the tracks being at least equal to the number of columns of apertures in the inner panel;

positioning the inner panel so that the inner panel is supported by the track support means adjacent the upper end of the inner panel with each aperture in each column of the inner panel aligned with an aperture in one of the tracks so that hook means on a module to be supported can be received in the aligned apertures in the inner panel and the tracks;

connecting a lower portion of the inner panel to a lower portion of each of the tracks;

and connecting the inner panel to the outer panel.

2. The method according to claim 1 including:

disposing first attaching means within an opening in the inner panel above the top of each column of apertures in the inner panel and an opening above the top of the column of apertures in each of the tracks to attach the inner panel and the tracks to the track support means for support thereby;

and disposing second attaching means within an opening in the inner panel beneath the bottom of each column of apertures in the inner panel and an aligned opening at the bottom of the column of apertures in each of the tracks to connect the inner panel to the lower end of each of the tracks.

3. The method according to claim 2 including:

forming the track support means with a set of openings;

and disposing each of the first attaching means within one of the openings of the set of openings in the track support means to attach the tracks and the inner panel to the track support means for support thereby.

4. The method according to claim 2 including:

forming the track support means with a set of openings;

positioning the track support means at the predetermined position by attaching the track support means to the outer panel;

and disposing each of the first attaching means within one of the openings of the set of openings in the track support means to attach the tracks and the inner panel to the track support means for support thereby so that the tracks and the inner panel are supported by the outer panel.

5. The method according to claim 1 including depositing insulating foam material within the outer panel to form rigid insulating foam means attached to the outer panel and the track support means prior to attaching the tracks and the inner panel to the track support means and the inner panel to the outer panel, the rigid insulating foam means constituting the rigid foam adhered to the outer panel.

6. The method according to claim 1 including:

forming the metallic outer door panel to have a base with first flanges perpendicular to the base and inturned second flanges substantially parallel to the base, and securing the track support means to the inturned second flanges.

7. The method according to claim 5 including:

depositing insulating foam material within the outer panel to form rigid insulating foam means with longitudinally parallel slots to receive the tracks.

* * * * *